US005938890A

United States Patent [19]

Schlinkmann et al.

[11] Patent Number: 5,938,890

[45] Date of Patent: Aug. 17, 1999

[54] ADHESIVE COMPONENTS PEEL AND APPLY APPARATUS AND METHOD

[75] Inventors: Jamie P. Schlinkmann, Tamarac; Alex W. Schlinkmann, Davie, both of Fla.

[73] Assignee: Automatic Manufacturing Systems, Inc., Fort Lauderdale, Fla.

[21] Appl. No.: 09/105,923

[22] Filed: Jun. 27, 1998

[51] Int. Cl.[6] ..... B65C 9/18; B65C 9/26; B65H 5/28

[52] U.S. Cl. ..... 156/541; 156/540; 156/238; 156/230; 221/73

[58] Field of Search ..... 156/361, 542, 156/540, 541; 226/158, 32, 43; 221/73

[56] References Cited

U.S. PATENT DOCUMENTS

| | | | |
|---|---|---|---|
| 3,619,326 | 11/1971 | Burbidge | 156/384 |
| 4,581,094 | 4/1986 | Sato | 156/352 |
| 4,687,535 | 8/1987 | Voltmer | 156/361 |
| 4,822,442 | 4/1989 | Ashcraft et al. | 156/361 |
| 4,943,337 | 7/1990 | Turkki | 156/384 |
| 5,236,535 | 8/1993 | Smith | 156/250 |
| 5,300,160 | 4/1994 | Wilson et al. | 156/64 |
| 5,304,264 | 4/1994 | Wehrmann | 156/64 |
| 5,489,360 | 2/1996 | Shimizu et al. | 156/542 |

FOREIGN PATENT DOCUMENTS

| | | | |
|---|---|---|---|
| 2555910 | 6/1977 | Germany | B65C 5/00 |
| 3233546 | 3/1984 | Germany | B65C 1/02 |
| 3911050 | 10/1990 | Germany | B65C 9/36 |

*Primary Examiner*—David A. Simmons
*Assistant Examiner*—Sue Purvis
*Attorney, Agent, or Firm*—Alvin S. Blum

[57] ABSTRACT

An apparatus and method for removing components that are adhesively mounted on a release coated web roll and applying them to items includes holding the component securely in a chuck and then peeling the web from underneath the component. This is achieved by forcing a chuck against a component on a movable peeler plate and holding it in place with vacuum. Tension on the web then pulls the peeler plate away from the component while the web passes over the edge of the peeler plate and peels the web from the adhesive face of the component.

17 Claims, 3 Drawing Sheets

ADHESIVE COMPONENTS PEEL AND APPLY APPARATUS AND METHOD

BACKGROUND OF THE INVENTION

This invention relates to methods and apparatus for peeling adhesive labels from a release coated web tape supply, while holding the peeled label, and applying the label precisely onto an item. It relates to adhesive components other than labels also.

Adhesive labels are generally supplied on a large tape roll of release coated web. The labels may be preprinted or may be printed in the label dispensing apparatus. Automatic peel and apply apparatus of the prior art generally holds the roll of labels and pulls the web, label side up, over a plate with a sharp edge and then pulls the web beneath the plate so that the label extends tangentially from the edge free of the web as the web changes direction. The label is grasped by its non-adhesive surface with a vacuum holder as it is released from the web. Problems arise in the methods of holding the label as it is released to ensure precision of final placement onto the item being labelled. The labels may not be uniformly spaced on the tape. If the label is not stiff enough, the label may wrinkle or bend as it is being released and grasped. To overcome such problems, the label designer may be forced to use a stiffer material than is otherwise desired. Since the holder must be at the edge of the peel plate as the label is peeled, it must be translated clear of the plate before it can be lowered onto an item in a complex motion that may be difficult to control precisely. U.S. Pat. No. 4,581,094 issued Apr. 8, 1986 to Sato translates the vacuum holder past the plate edge in synchronism with the tape travel. U.S. Pat. No. 4,687,535 issued Aug. 18, 1987 to Voltmer uses a vacuum drum that rotates past the peel plate edge. These and the other prior art label dispensers, as far as we know, all use a peel plate that does not move. They have various complex mechanisms that are expensive to manufacture and maintain and that often lack precision of placement.

SUMMARY OF THE INVENTION

It is accordingly an object of the invention to provide an apparatus and method for removing adhesive labels one at a time from a roll of release tape and precisely placing the label on an item regardless of the stiffness of the label or irregularity of label spacing on the carrier web. The apparatus holds a roll of labels on a release coated tape web. The web is pulled along a flat horizontal surface terminating in a movable peel plate. The tape reverses direction and is pulled over the sharp edge of the plate and then under the peel plate. A sensor detects the position of the label on the web. A vertically movable vacuum holding head is positioned over the peel plate. Sensor information actuates a brake that clamps onto the tape, preventing its movement and at the same time a holding head presses onto a label positioned on the peel plate. The web is pulled, moving the peel plate toward the brake, and peeling the web away from the label held in the holder as the sharp edge moves under the held label.

Because the label is first clamped between the holder and the peel plate, before the web is removed, the label does not have to be stiff. Because the entire peel plate is pulled away from beneath the holder, the holder requires only vertical motion for applying the held label onto an item for greater simplicity and precision.

Other web carried adhesive components that may be used with this invention include, for example, double sided adhesive strip, gaskets, and thermal transfer tapes.

These and other objects, advantages and features of the invention will become more apparent when the detailed description is studied in conjunction with the drawings, in which like elements are designated by like reference characters in the various drawing figures.

DETAILED DESCRIPTION OF PREFERRED EMBODIMENTS

Figure 1:
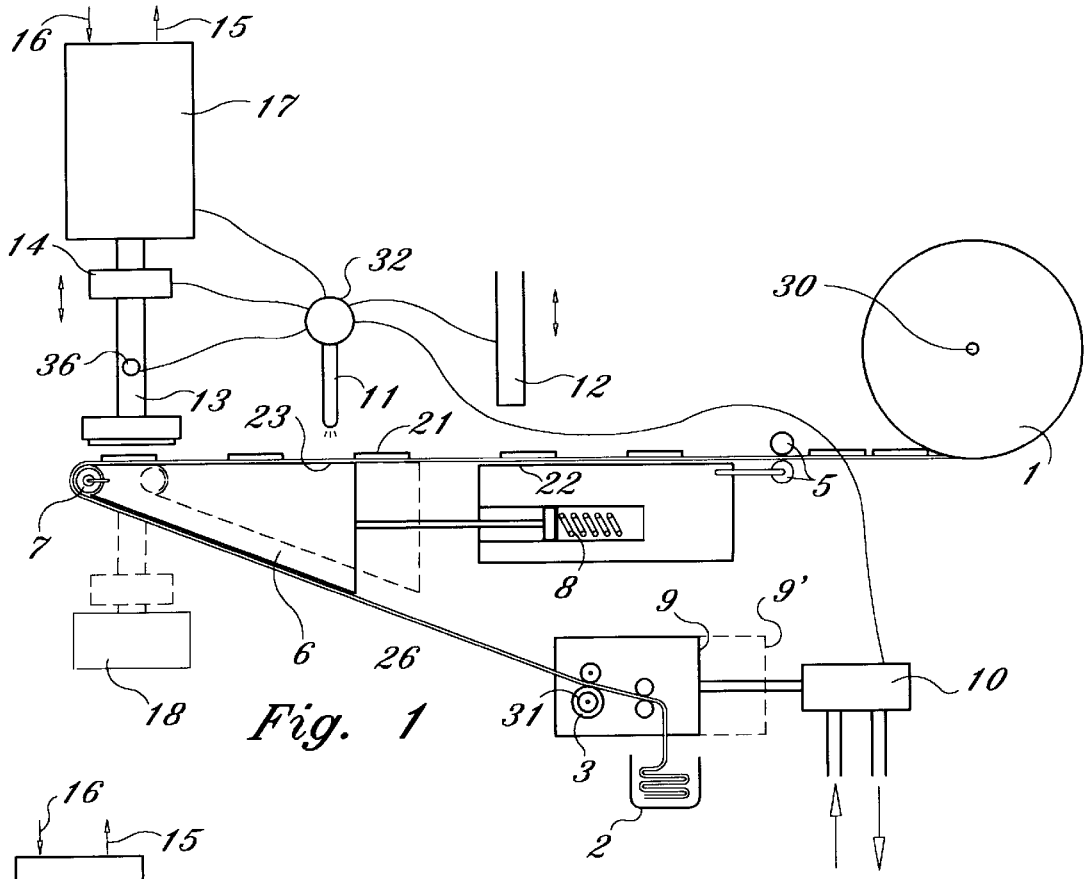
FIG. 1 is a schematic side elevation view of the invention when a component has moved under the component holding chuck.

Referring now first to FIGS. 1–6, a supply reel 1 of release coated web tape 26 is rotatably mounted on a fixed pivot 30. The tape is pulled through guide rollers 5 and across a flat stationary first surface 22 beneath brake 12 mounted for translation between the clearance position shown in FIG. 1 and the braking position shown in FIG. 2 when the tape is pressed firmly against surface 22 to prevent tape movement. The tape is next passed over the planar surface 23 of the movable peeler plate 6 that is held in the position of FIG. 1 by compression spring 8, and over the roller peeling edge 7 to the drive roller 3 driven by stepper motor 31 that pinches the web and pulls it eventually to the waste bin 2. A sensor 11 that may be, for example, optical or ultrasonic positioned over the web as it passes, senses the trailing edge of the component, and sends a signal to microprocessor control 32.

Figure 2:
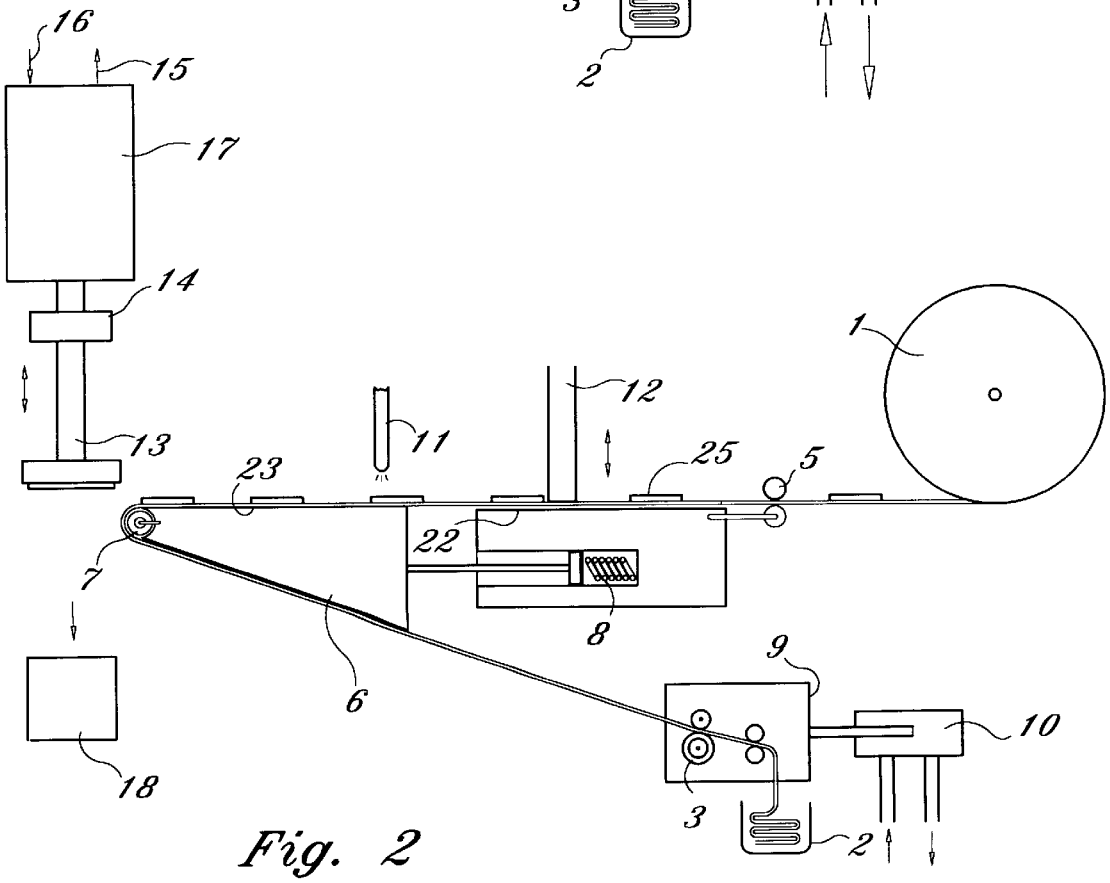
FIG. 2 is a view as in FIG. 1 with the component peeling process partially completed.
Figure 3:
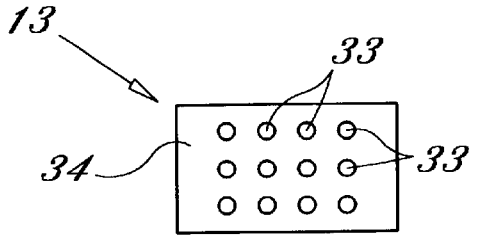
FIG. 3 is a plan view of the component holding face of the chuck.

A signal sent to brake 12 causes it to clamp down on the tape as in FIG. 2. A signal to chuck 13 causes it to clamp down at the same time. This time is calculated to be when the component is directly beneath the chuck as determined by the sensing of the component trailing edge and the speed of the tape drive moving roller 3. As the chuck clamps down on the upper face of the component, suction from vacuum source 15 is applied through valve 17 to the perforations 33 in the rubber face of the chuck to hold the component securely. A means 36 for sensing a preset level of vacuum developed when the chuck is engaging the component may optionally be provided in the vacuum path to indicate improper operation. The sensor 36 may be wired to the microprocessor 32. It may be any one of many vacuum sensors well known in the pneumatic art such as, for example, miniature absolute pressure transducer model No. PX 136-015AV from Omega Engineering Inc. Box 4047, Stamford, Conn. 06907. When the chuck is securely engaging the component a predictable vacuum will develop. When a component is missing or a poor engagement occurs, the system can alert the operator of trouble.

Since the component 21 is resting on the web, the web is resting on planar surface 23, and chuck 13 is forced against the component by chuck drive 14, a seal between the rubber face 34 of chuck 13 and the upper face 25 of the component is made. Suction through the holes 33 ensures secure holding of the component while the web 26 is peeled from the lower adhesive coated face 24 of the component by the following mechanism. The tape drive or web moving means 3 is movably mounted on tape drive support assembly 9. A two way air cylinder 10 moves the assembly 9 between a first position shown in FIG. 1, and a retracted second 9' position shown in phantom in FIG. 1.

Figure 4:
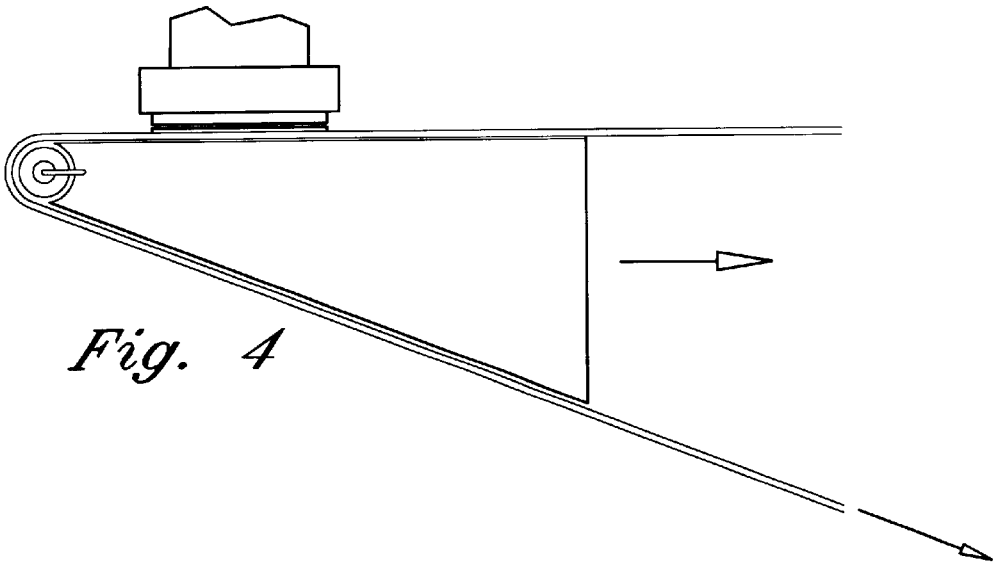
FIG. 4 is an enlarged detail of the chuck engaging the component a moment after the time of FIG. 1.
Figure 5:
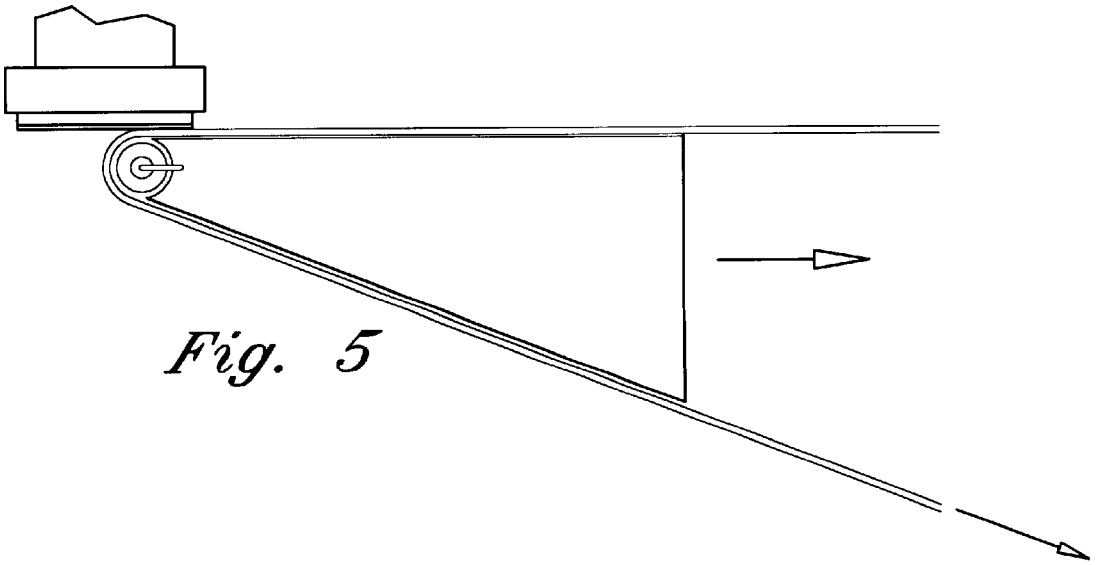
FIG. 5 is an enlarged detail of the chuck at the time of FIG. 2.
Figure 6:
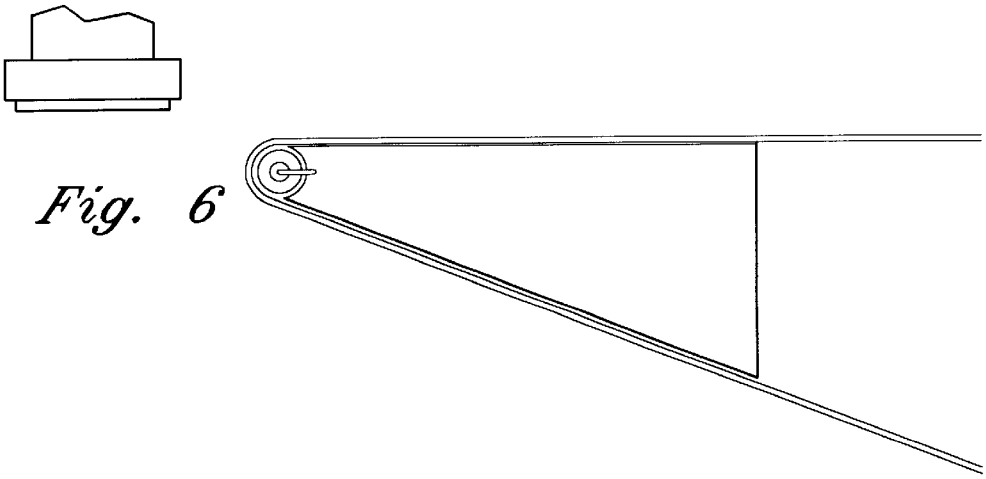
FIG. 6 is an enlarged detail of the chuck after peeling has been completed.

Assembly 9 is shown partially retracted in FIG. 2. As the tape drive is pulled from its first position toward its second position, tension is applied to the tape portion up to brake 12 that prevents the tape reel from unwinding. This sudden tensioning of the tape pulls the movable plate from the position shown in FIG. 1 to the right, compressing spring 8 and peeling the tape from beneath the held component as the peeling edge roller moves from left to right beneath the held component, as illustrated in FIGS. 4–6. Because the peeler plate 6 is now clear of the chuck, it may be moved down to a third location forcing the component against the item 18. A pulse of compressed air may be optionally forced through the chuck from source 16 to further force the component against item 18. The chuck may now be returned to its uppermost position and the assembly 9 forced back to its original position. This creates slack in the web, enabling the spring 8 to return peeler plate 6 to its original position.

Alternatively, the assembly 9 may be stationary and the web moving means 3 may be used to pull the peeler plate through the peeling process.

Figure 7:
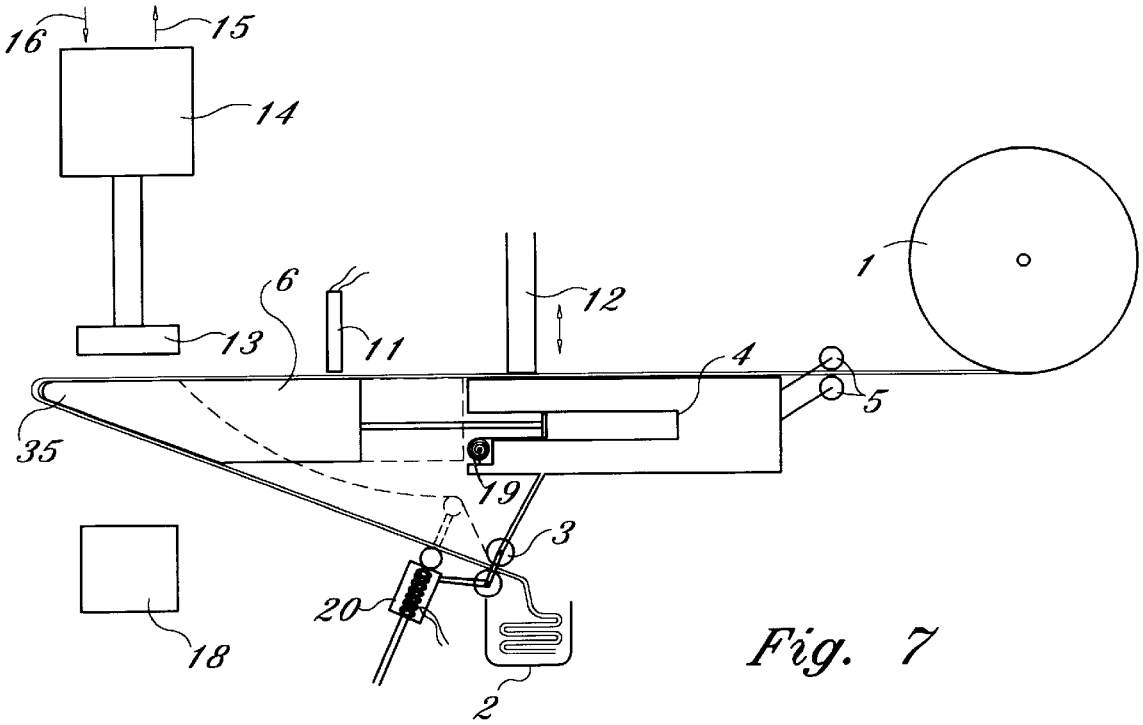
FIG. 7 is a schematic side elevation view of an alternative embodiment of the invention.

Referring now to FIG. 7, an alternative embodiment of the invention is shown in which the drive assembly means 3 is also stationary, and tension on the web to pull the peeler plate rapidly beneath the held component is provided by a solenoid 20 which forces the web to the position shown in phantom. After the component has been peeled and applied and the chuck returned to its uppermost location, a spring motor 19 forces the peeler plate all the way to the left, ready for the next component as the solenoid releases the tension on the web. In this embodiment the peeling edge 35 is not provided with a roller.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. In a system for adhesively applying to an item components that have a broad adhesive first face and a broad opposed second face, wherein the components are initially attached to a web by the first face, apparatus for securely holding the component while on the web and peeling the web from the held component, the apparatus comprising:

A) a stationary first surface;

B) a peeler plate having a second surface and a peeling edge mounted for translatory motion in a first direction to a first position away from the first surface and in a second direction to a second position toward the first surface;

C) a web moving means for pulling the web along the first surface and the second surface and around the peeling edge;

D) a component chuck means for removably engaging the second face of the component, the component chuck means mounted for motion between at least two locations, a first location in which the chuck means is above the component when the peeler plate is in the first position, and a second location wherein the chuck means is pressed against the entire component, the web, and the second surface when the peeler plate is in the first position, the chuck means being provided with means for securely holding the component;

E) sensor means for sensing position of a component on the web while the web is being pulled across the first surface and peeler plate and past the sensor means;

F) brake means for arresting motion of the web, the brake means mounted adjacent the first surface and positioned so as to press the web against the first surface when actuated in response to the sensing means sensing that a component is entirely beneath the chuck means;

G) means forcing the chuck means from the first location to the second location when the sensing means indicates that a component is entirely beneath the chuck means; and H) puller means for pulling the web across the peeling edge and for causing the pulled web to move the peeler plate from the first position to the second position while the component is securely held by the chuck means and the web is held by the brake means so as to peel the web from the held component.

2. The apparatus according to claim 1 in which the peeling edge includes a roller;

spring bias is provided for moving the peeler plate from the second to the first position;

the chuck means is provided with a vacuum for securely holding the component; and the puller means comprises a mechanism that forces the web moving means in the second direction to thereby peel the web from the held component and to cause the moving web to move the peeler plate to the second position; and then force the web moving means in the first direction, causing the web to lose tension and thereby allowing the spring bias to move the peeler plate back to the first position.

3. The apparatus according to claim 2, further comprising a third location for the chuck means in which the component is held by vacuum in the chuck means while the peeler plate is in the second position and the held component has moved past the plane of the planar surface to enable the adhesive face of the component to engage the surface of the item, the chuck means being further provided with air pressure to force the component from the chuck means when the component contacts the item.

4. The apparatus according to claim 3, further comprising vacuum measuring means operatively connected to the chuck means for indicating when a component is not securely held in the chuck means.

5. The apparatus according to claim 1 in which:

the tension applied to the web by the web moving means forces the web into a straight line between the peeling edge and the web moving means;

spring bias is provided for moving the peeler plate from the second to the first position;

the chuck means is provided with a vacuum for securely holding the component; and the puller means comprises a mechanism that forces the web in tension away from said straight line to thereby move the peeler plate in the second direction to the second position, and peeling the web from the held component in a first mode of operation, and retracting away from the web in a second mode of operation to create slack in the web, thereby allowing the peeler plate to return to the first position through action of the spring bias.

6. The apparatus according to claim 5, further comprising a third location for the chuck means in which the component is held by vacuum in the chuck means while the peeler plate is in the second position and the held component has moved past the plane of the planar surface to enable the adhesive face of the component to engage the surface of the item, the chuck means being further provided with air pressure to force the component from the chuck means when the component contacts the item.

7. The apparatus according to claim 6, further comprising vacuum measuring means operatively connected to the chuck means for indicating when a component is not securely held in the chuck means.

8. The apparatus according to claim 5, further comprising vacuum measuring means operatively connected to the chuck means for indicating when a component is not securely held in the chuck means.

9. The apparatus according to claim 2, further comprising vacuum measuring means operatively connected to the chuck means for indicating when a component is not securely held in the chuck means.

10. The apparatus according to claim 1, in which the components are labels.

11. The apparatus according to claim 1, further comprising:

spring bias means for moving the peeler plate in the first direction;

vacuum means in the chuck means for securely holding the component; and the puller means comprising a mechanism that forces the web moving means in the second direction to thereby peel the web from the held component and to cause the moving web to move the peeler plate to the second position and then forces the web moving means in the first direction, causing the web to lose tension between the peeler plate and the web moving means, thereby allowing the spring bias to move the peeler plate back to the first position.

12. The apparatus according to claim 1 in which:

spring bias is provided for moving the peeler plate from the second to the first position;

the chuck means is provided with a vacuum for securely holding the component; and the puller means comprises a mechanism that forces the web moving means in the second direction to thereby peel the web from the held component and to cause the moving web to move the peeler plate to the second position, and then force the web moving means in the first direction, causing the web to lose tension and thereby allowing the spring bias to move the peeler plate back to the first position.

13. The apparatus according to claim 1 further comprising a third location for the chuck means in which the component is held by vacuum in the chuck means while the peeler plate is in the second position and the held component has moved past the plane of the second surface to enable the adhesive face of the component to engage the surface of the item, the chuck means being further provided with air pressure to force the component from the chuck means when the component contacts the item.

14. The apparatus according to claim 1 in which the first and second surfaces are substantially coplanar.

15. In a system for adhesively applying to an item components that have a broad adhesive first face and a broad opposed second face, wherein the components are initially attached to a web by the first face, apparatus for securely holding the component while on the web and peeling the web from the held component, the apparatus comprising:

a stationary first surface;

a peeler plate having a second surface and a peeling edge mounted for translatory motion in a first direction to a first position away from the first surface and in a second direction to a second position toward the first surface;

a web moving means for pulling the web along the first surface and the second surface and around the peeling edge;

a component chuck means for removably engaging the second face of the component, the component chuck means mounted for motion between at least two locations, a first location in which the chuck means is above the component when the peeler plate is in lthe first position, and a second location wherein the chuck means is pressed against the entire component, the web, and the second surface when the peeler plate is in the first position, the chuck means being provided with means for securely holding the component;

sensor means for sensing position of a component on the web while the web is being pulled across the first surface and peeler plate and past the sensor means;

brake means for arresting motion of the web, the brake means mounted adjacent the first surface and positioned so as to press the web against the first surface when actuated in response to the sensing means sensing that a component is entirely beneath the chuck means;

means forcing the chuck means from the first location to the second location when the sensing means indicates that a component is entirely beneath the chuck means;

puller means for pulling the web across the peeling plate from the first position to the second position while the component is securely held by the chuck means and the web is held by the brake means so as to peel the web from the held component, spring bias is provided for moving the peeler plate from the second to the first position;

the chuck means is provided with a vacuum for securely holding the component; and the puller means comprises a mechanism that forces the web moving means in the second direction to thereby peel the web from the held component and to cause the moving web to move the peeler plate to the second position, and then force the web moving means in the first direction, causing the web to lose tension and thereby allowing the spring bias to move the peeler plate back to the first position.

16. In a system for adhesively applying components that have a broad adhesive first face and a broad opposed second face to items wherein the components are initially attached by the first face to an elongate web in a source of components, a method for securely holding the component and peeling the web from the held component ready for applying the held component to an item, the method comprising:

A) pulling the web in a motion from the source of components across a peeler plate, between the peeler plate and a component holding chuck and over a peeling edge on the peeler plate;

B) when a component is located entirely between the peeler plate and the chuck, arresting the motion of the web from the source;

C) forcing the chuck against the second face of the component while the component is motionless on the web and entirely supported by the web and the peeler plate therebelow;

D) applying suction to the chuck to hold the component securely and immobile thereon; and E) pulling the web around the peeling edge to peel the web from the first face of the held component and to cause the pulled web to move the peeler plate from beneath the component so as to peel the web from the first face of the held component.

17. The method according to claim 16 in which the peeling edge comprises a roller.

* * * * *